United States Patent [19]

Vollmar et al.

[11] 4,384,540

[45] May 24, 1983

[54] SEWING MACHINE HAVING A CUTTING DEVICE

[75] Inventors: Kurt Vollmar; Karl H. Walther, both of Weilerbach, Fed. Rep. of Germany

[73] Assignee: Pfaff Industriemaschinen GmbH, Fed. Rep. of Germany

[21] Appl. No.: 310,982

[22] Filed: Oct. 13, 1981

[30] Foreign Application Priority Data

Nov. 11, 1980 [DE] Fed. Rep. of Germany ..... 3042465

[51] Int. Cl.[3] ..... D05B 37/06

[52] U.S. Cl. ..... 112/129; 112/123 R

[58] Field of Search ..... 112/129, 130, 127, 123 R

[56] References Cited

U.S. PATENT DOCUMENTS 1,232,365 7/1917 Moffatt ..... 112/129 X 3,009,432 11/1961 Reeber et al. ..... 112/129 X 3,756,174 9/1973 Wenz et al. ..... 112/129 X

FOREIGN PATENT DOCUMENTS 2719894 11/1978 Fed. Rep. of Germany ..... 112/130

*Primary Examiner*—Werner H. Schroeder

*Assistant Examiner*—Andrew M. Falik

*Attorney, Agent, or Firm*—McGlew and Tuttle

[57] ABSTRACT

A sewing machine has a work bearing surface in a substantially horizontal plane and a cutting device for the work including a bottom knife disposed in the horizontal plane of the work bearing surface and a top knife movable in the vertical direction. The cutting device has a toggle lever transmission drive comprising two articulatedly connected connecting rods, the joint of which is connected with a drive element. One of the two connecting rods is connected, at an outer joint thread with the top knife.

2 Claims, 7 Drawing Figures

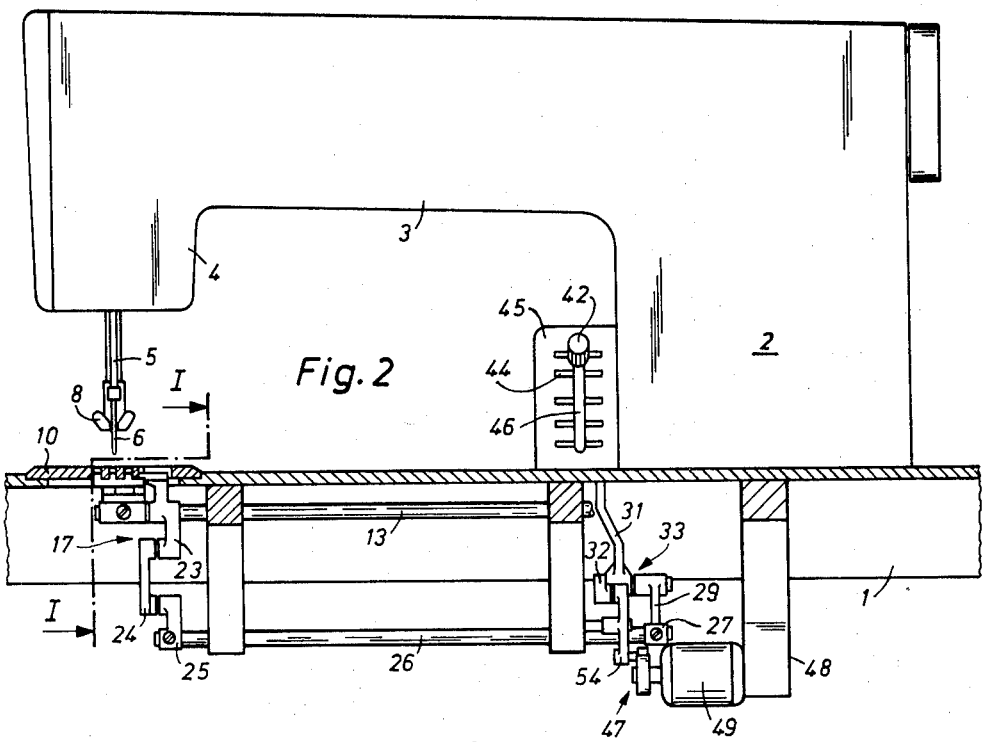
Fig. 2
Fig. 3
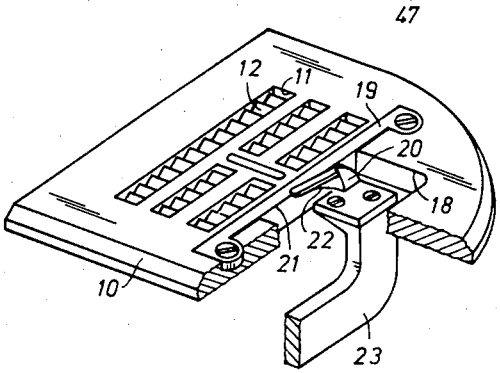
Fig. 4
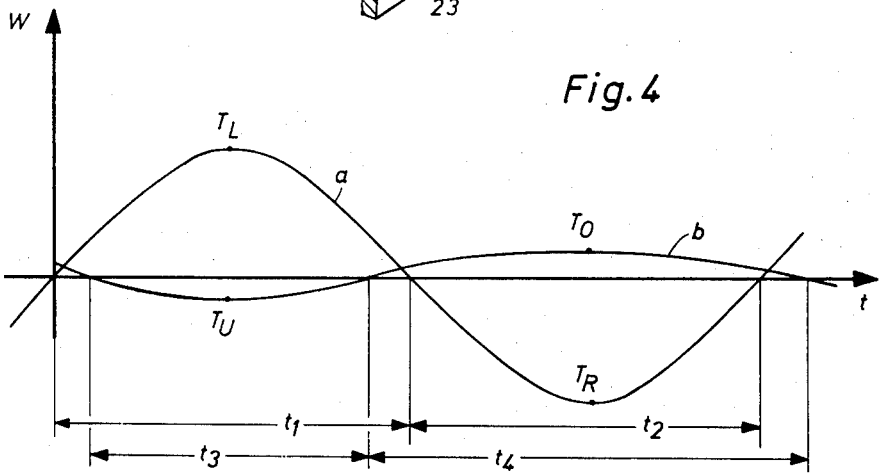

SEWING MACHINE HAVING A CUTTING DEVICE

FIELD AND BACKGROUND OF THE INVENTION

The invention relates to sewing machines in general, and, more particularly to a new and useful sewing machine having a cutting device including a bottom knife disposed in the plane of the work bearing surface and a top knife movable in a vertical direction, a drive device formed by a toggle lever transmission comprising two articulately connected connecting rods with a central joint connected with a drive element and an outer joint of one of the two connecting rods with a top knife.

In sewing machines with a cutting device for cutting the work, difficulties may arise in the trimming of work edges parallel to the sewing directions when for technical reasons the trimming device is driven, not from the drive mechanism of the sewing machine, but by its own independent drive. Since, in this case, the up and down movement of the top knife is not synchronized with the feed movement of the feed elements of the sewing machine, it may happen that the top knife is in its lowered position and cooperating with the bottom knife and touching the work precisely when the work is to be moved forward. As a result, the work piles up at the top knife and thus is pushed out of the desired feed direction.

This disadvantageous effect could be diminished by increasing the cutting frequency, because due to the greater number of cutting operations per unit time, the presence of the top knife in the position which hinders the work advance is shortened. Increased cutting frequency, however, inevitably leads to early wear of the knife edges.

West German Offenlegungsschrift No. 27 19 894 discloses a scissors, disposed crosswise to the sewing direction, which consists of a fixed lower knife and an upper knife movable up and down. The upper knife which is is connected with a toggle lever transmission formed by two connecting rods and driven by a compressed air cylinder. To carry out a cutting operation, a piston rod is moved from one end position to the other, the two connecting rods thus being swung from a first bent position through the extended position into a mirror-symmetrical second bent position. In the two bent positions of the connecting rods, the upper knife is raised, and is lowered into cutting position only in the extended position of the connecting rods. Since the piston rod moves very quickly through the position in which the connecting rods are extended and the upper knife is in cutting position, the connecting rods are swung through their extended position comparitively quickly. By this measure, the upper knife is expected to be moved, with an especially fast action, toward the end of its downward movement and at the beginning of its upward movement, so that its presence in the lowered position and hence the actual cutting operation are relatively short.

The scissors being arranged crosswise to the sewing direction may be usable for the cutting of ribbons or thread chains at the end of a workpiece and hence for a mode of operation which is interrupted by intermissions. For the trimming of work edges occurring at high frequency parallel to the sewing directions, however, it is entirely unsuitable, even if the scissors were rotated by 90° and its knives would be parallel to the sewing direction. It would, in fact, be impossible with a pneumatically operating drive device, which in this case would have to have besides the air cylinder, a clock pulse generator consisting of several valves, to achieve a cutting frequency approximately corresponding to the speed of high-speed sewing machines.

The known scissors has still another fundamental disadvantage. As the connecting rods of the toggle lever transmission move from the two bent positions into the extended position, the path traveled by the joint connected with the upper knife constantly decreases in relation to the path traveled in the same time by the drive element due to the then constantly flattening angle between the connecting rods, until in the extended position of the connecting rods it is zero altogether, whereupon the knife stands still. This movement pattern is in contradiction with the effect intended by the rapid swinging of the connecting rods through their extended position, namely to obtain a shortened presence of the upper knife in the lowered position, and cancels out the intended effect at least in part.

SUMMARY OF THE INVENTION

It is the object of the invention to provide a sewing machine having a cutting device for the work including a bottom knife disposed in a horizontal plane of the work bearing surface and a top knife movable in a vertical direction, and a toggle lever transmission driving the cutting device, the toggle lever transmission including two connecting rods articulately connected at a central joint, a drive member connected to the connecting rods at the central joint, and one of the two connecting rods being connected at an outer joint with the top knife which is suitable for the trimming of work edges occurring parallel to the sewing direction at great frequency and in which the time spent by the upper knife in the cutting position is reduced. The problem is solved by providing an eccentric drive means for swinging the connecting rods back and forth between a bent position and a substantially extended position, relative to each other, the top knife being, when the connecting rods are in the extended position, in a raised position removed from the bottom knife and, when the connecting rods are in bent position, the top knife being in a lowered position cooperating with the bottom knife.

With the cutting device, according to the invention, there also arises, due to the use of a toggle lever transmission, the situation that as the connecting rods of the toggle lever transmission move from the bent to the extended position the path traveled by the joint connected with the top knife likewise decreases constantly in relation to the path traveled in the same time, by the drive element. This is due to the fact that the angle between the connecting rods becomes flatter and flatter, until in the extended position of the connecting rods it becomes zero. Since in the cutting device according to the invention, the lowest position of the top knife, which is at the same time the cutting position, is reached with the connecting rods being in bent position, and the highest position of the top knife is reached with the connecting rods being in extended position, the greater relative velocity of the coupling joint connected with the top knife occurs in the lowered, and the smaller relative velocity of the coupling joint in the raised, position of the top knife. In this manner the coupling joint and hence the top knife is moved relatively fast through the lower portion and hence during the actual cutting operation and relatively slowly through the upper portion of its movement path.

By driving the toggle lever transmission through an eccentric drive, the drive element of the toggle lever transmission being either formed by the eccentric rod itself or being connected therewith through other transmission elements, a harmonious and therefore vibration-free drive movement is achieved, which also permits a high cutting frequency.

Since the connecting rods of the toggle lever transmission swing back and forth only between one bent position and the extended position, and not through the extended position into a mirror-symmetrical second bent position, the drive element of the toggle lever transmission is in a reversal point of its movement path both in the bent position and in the extended position of the connecting rods. Since, therefore, the movement conditions of the drive element are substantially identical during the time that the connecting rods are in bent and in extended positions, the irregular movement conditions of the toggle lever transmission in the region of the bent and extended positions remain uninfluenced by the movement conditions of the drive element.

In the cutting device according to the invention, therefore, the top knife is in a raised position removed from the bottom knife for a relatively long time and in a lowered position cooperating with the bottom knife for only a relatively short time. It is achieved thereby that with a drive of the cutting device independent of the sewing machine the advance of the work is not impeded even if the cutting operation and the work advance happen to coincide in time. This advantageous effect could, if needed, be intensified in that the drive element drives the toggle lever transmission irregularly in such a way that it executes a faster drive movement with the top knife lowered and a slower one with the top knife raised. For this purpose the drive element could be formed by a second toggle lever transmission whose connecting rods move synchronously with the connecting rods of the other toggle lever transmission.

According to a further proposal of the invention, the outer joint of the connecting rods not connected with the top knife can be displaced in a direction extending obliquely to the extended position of the connecting rods. By this measure the stroke height of the top knife is adaptable to different work thicknesses. Another advantage of this measure is that in case the drive elements of the top knife are disposed below the work bearing surface of the sewing machine, the top knife can be lowered, if necessary, entirely below the work bearing surface by displacement of the joint of the connecting rod which is not connected to the top knife.

Thus, in accordance with the invention, there is provided an improved sewing machine of the type having a work bearing surface in a substantially horizontal plane, a cutting device for the work including a bottom knife disposed in the horizontal plane of the work bearing surface and a top knife movable in a vertical direction. Toggle lever transmission means are provided for driving the cutting device, which include two connecting rods articulately connected at a central joint, a drive member connected to the connecting rods at the central joint, and one of the two connecting rods being connected at an outer joint with the top knife. The improvement of the invention comprising an eccentric drive means for swinging the connecting rods back and forth between a bent position and a substantially extended position relative to each other, the top knife being, when the connecting rods are in extended position, in a raised position removed from the bottom knife and, when the connecting rods are in the bent position, the top knife being in a lowered position cooperating with the bottom knife.

It is a further object of the invention to provide an improved sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a sectional view of the sewing machine along line II—II of FIG. 1;

FIG. 3 is a perspective view of the top and bottom knives of the cutting device;

FIG. 4 is a diagram of the movement sequence of the drive element and of the top knife during one revolution of the driving eccentric.

DETAILED DESCRIPTION

Figure 1:
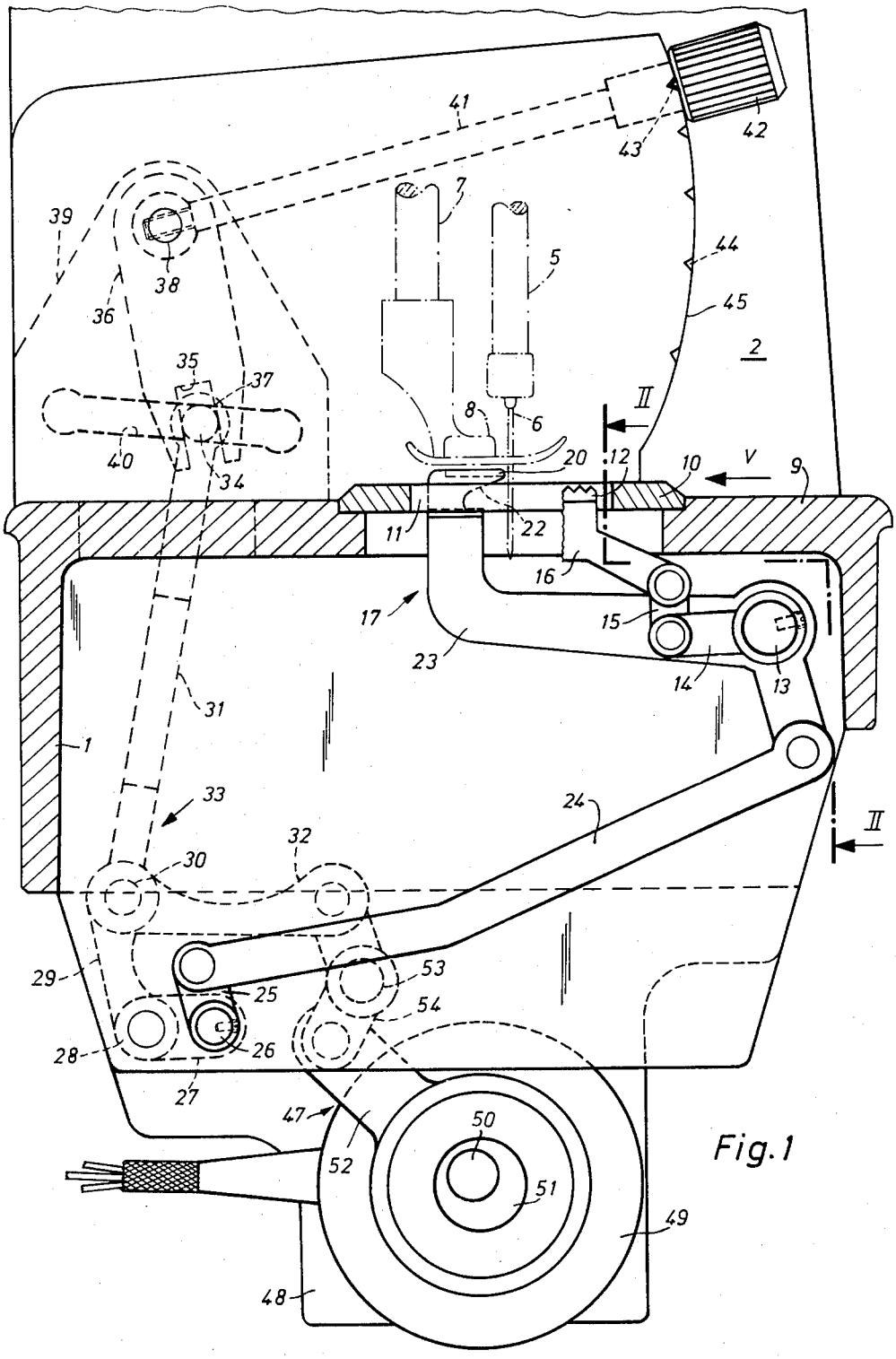
FIG. 1 is a sectional view of a part of the sewing machine taken along line I—I of FIG. 2 showing the knife driving parts in a first position.
Figure 5:
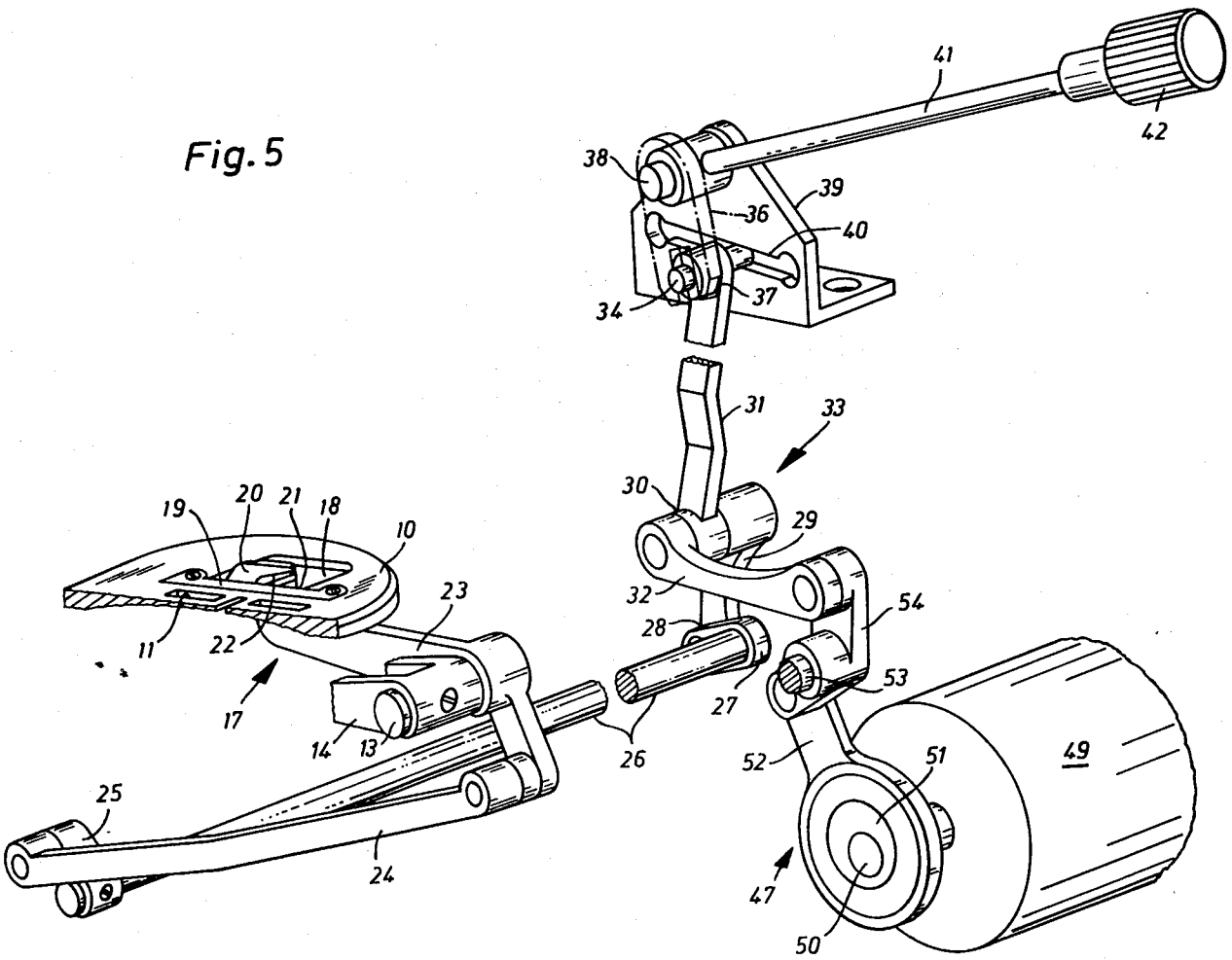
FIG. 5 is a perspective view of the drive train in accordance with the invention for driving the top knife.

The sewing machine illustrated in the figures is composed of a bottom housing 1, a pedestal 2, an arm 3, and a head 4. In head 4 is disposed a needle bar 5 movable up and down in known manner and carrying a thread-holding needle 6. A presser bar 7 is also mounted in head 4, at whose end a presser foot 8 is arranged. A stitch plate 10 is embedded in a base plate 9 of the bottom of housing 1, which is provided with a recess 11 for the passage of a work feed 12. For the advance of the work, feed 12 executes in known manner a rectangular movement. Of the drive elements for the work feed 12, only the drive shaft 13 which generates a stroke, a crank 14, a link 15, and a support 16 for receiving the work feed 12, are shown.

A cutting device 17 includes a bottom knife 19 attached to the stitch plate 10 and extending laterally of the work feed 12 in a recess 18, as well as a top knife 20 cooperating therewith. The bottom knife 19 has a horizontally extending cutting edge 21, while the top knife 20 has a cutting edge 22 extending obliquely thereto. The top knife 20 is fastened on an upwardly bent end of an angle lever 23, which is rotatably mounted on the drive shaft 13. The angle lever 23 is connected with one end of a pull rod 24, whose other end is articulated to a crank 25. Crank 25 is fastened to one end of a shaft 26. At the other end of shaft 26 a crank 27 is fastened.

The crank 27 is connected by means of a joint 28 to a connecting rod 29, which is connected by a joint 30 to a second connecting rod 31. The two connecting rods 29, 31 together with a drive element engaging at joint 30 and designed as a link 32 forms a toggle lever transmission 33. The end of connecting rod 31 opposite joint 30 carries a pin 34 which is received in a slot 35 in a lever 36. Pin 34 and slot 35 form a joint 37. Lever 6 is fastened on a bolt 38 which is mounted in a plate 39 disposed laterally of the pedestal 2. In plate 39 is formed an obliquely extending guide slot 40, in which pin 34 is received. A lever 41 whose free end carries an axially displaceable handle 42 is fastened to lever 36. At the end of handle 42 toward lever 41 a rib 43 is formed. A spring (not shown) pulls the handle 42 toward the bolt 38 and thereby causes the rib 43 to engage in one of several notches 44 contained on the exterior of a housing 45 covering the levers 36,41. There is formed in housing 45 also a vertically extending slot 46, in which lever 41 is received. Means are thus provided for holding the joint 37 in a selected position in a direction extending obliquely to the extended position of the connecting rods 29,31.

An eccentric drive 47 is used to drive the toggle lever transmission 33. It comprises a drive motor 49 mounted on a support plate 48 of the bottom housing 1, an eccentric 51 mounted on the motor shaft 50, and an eccentric rod 52 embracing the eccentric 51. The eccentric rod 52 is connected to the link 32 by means of a two-arm crank 54 mounted on a fixed bolt 53.

The cutting device operates as follows. The drive motor 49 may be turned on, both while the sewing machine is running and while it is standing still. With the drive motor 49 turned on, the eccentric 51 drives the eccentric rod 52 in reciprocating movements, whereby the crank 54 executes swinging movements about the bolt 53. They cause the link 32 to execute reciprocating movements which are transmitted via the joint 30 to the connecting rods 29,31. The connecting rods 29, 31 move continuously between the bent or first position shown in FIGS. 1 and 7 and the extended or second position shown in FIG. 6, in which they are aligned with each other.

The reciprocating movement of link 32 is a sinusoidal movement. The movement pattern of joint 30 of link 32 during one revolution of the eccentric 51 is represented by curve a in the diagram shown in FIG. 4. In this diagram the path W is plotted on the ordinate and the time T on the abscissa. The portion of curve a lying above the abscissa shows the left half of the movement path of joint 30, and the portion lying below the abscissa the right half of the movement path. The upper apex of curve a represents the left dead center $T_L$ of the movement path of joint 30 and the lower apex the right dead center $T_R$. As the movement of joint 30 of link 32 is sinusoidal, the time $t_1$ for traversing the left half of the movement path is exactly as long as the time $t_2$ for traversing the right half.

Since joint 37 of the toggle lever transmission 33 is retained in the vertical direction by the guide slot 40 and in the horzontal direction by the fixed lever 36, the swinging movements of the connecting rods 29, 31 bring about a continuous up and down movement of joint 28. This movement is not sinusoidal, as the connecting rods 29, 31 cause in the region of their bent position a much greater vertical movement of joint 28 than in the region of their extended position. This non-sinusoidal swinging movement of joint 28 is transmitted via crank 27, shaft 26, crank 25 and pull rod 24 to the angle lever 23, whereby the top knife 20 executes a likewise non-sinusoidal up and down movement. The movement pattern of the top knife 20 during one revolution of eccentric 51 is represented in the diagram by curve b, the lower half of the travel or respectively of the movement path lying below and the upper half above the abscissa. The abscissa does not identify the position of the cutting edge 21 of the bottom knife 19. The lower apex of curve b represents the lower dead center $T_U$ of the movement path of the top knife 20 and the upper apex the upper dead center $T_0$. The non-sinusoidal form of the movement has the effect that the top knife 20 requires for traversing the lower half of the movement path a relatively short time $t_3$ and for traversing the upper half a considerably longer time $t_4$.

Since the cutting edge 22 of the top knife 20 extends obliquely and the cutting edge 21 of the bottom knife 19 extends horizontally, the intersection of the two cutting edges 21,22 shifts during the downward movement of the top knife 20 counter to the feed direction V of the work, and during the upward movement in feed direction V. Now since the lower half of the movement path of the top knife 20 is traversed very rapidly and the upper half comparitively slowly, the top knife 20 is, after completion of a trimming operation, that is, after it has reached the lower dead center $T_U$ of its movement path, moved up very rapidly from the lowered position to a position between the two dead centers $T_U$ and $T_0$, and the intersection of the cutting edges 21, 22 during the first half of the movement in the feed direction V likewise rapidly. The speed of the intersection of the cutting edges 21,22 is here greater than the feed speed of the work at maximum speed of rotation of the sewing machine and greatest possible advance of the work feed 12. In this way, even when, during operation of the sewing machine, the forward movement of the work starts exactly when the top knife 20 is at the lower dead center $T_U$, the work cannot strike against the cutting edge 22.

After the middle position of the top knife 20 between the two dead centers $T_U$ and $T_0$ has been reached, the intersection of the two cutting edges 21, 22 has moved in the feed direction V so far that the work again cannot strike against the cutting edge of the top knife 20 during the second half of the upward movement of the top knife 20, which occurs at reduced speed. Due to these movement conditions the cutting device is thus particularly suitable for those cases of use where the drive is not derived from the drive mechanism of the sewing machine, but occurs by means of an independent motor.

Figure 6:
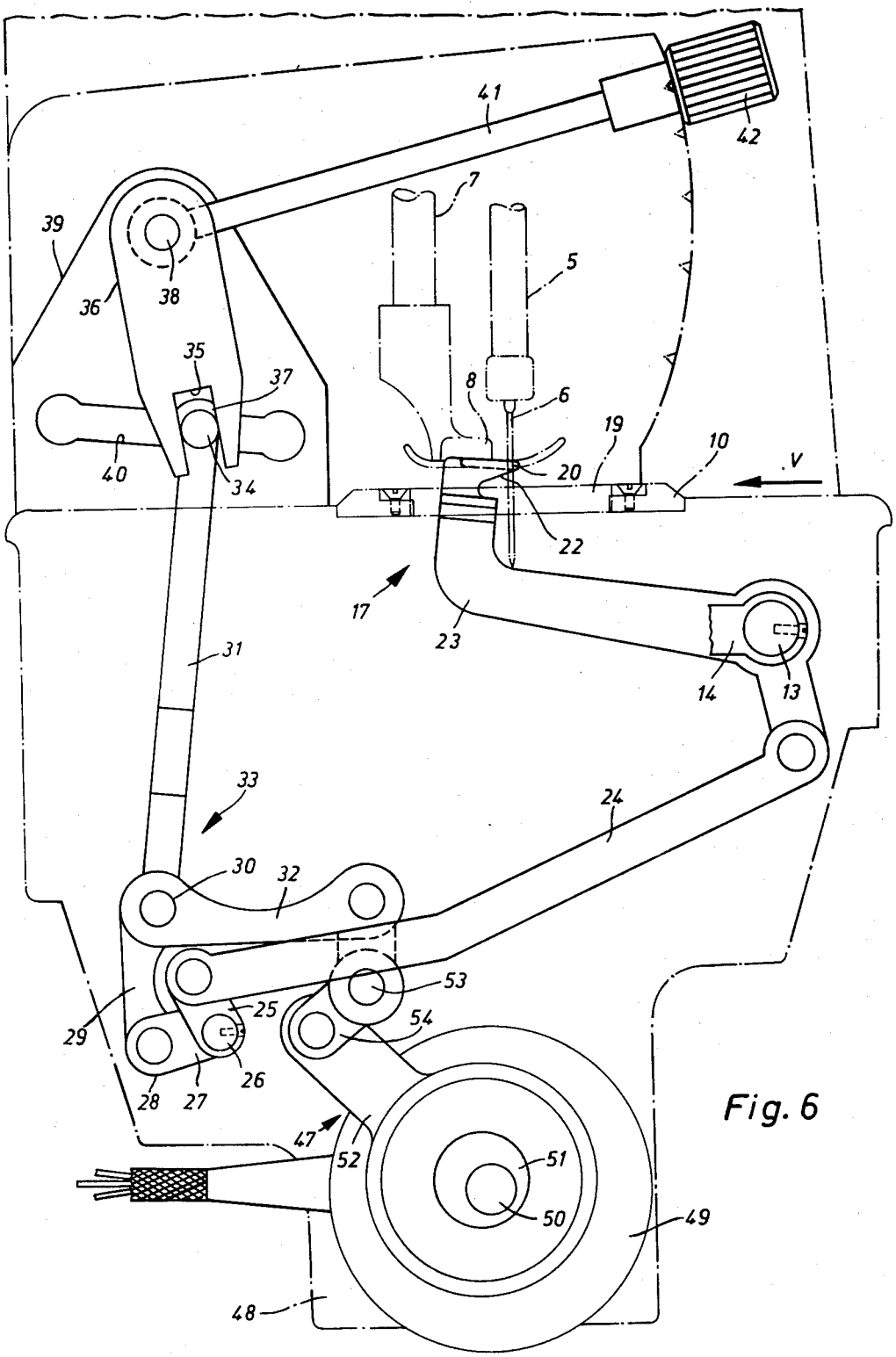
FIG. 6 is a view similar to FIG. 1 with parts of the housing removed for clarity and with the knife driving parts in a second position.
Figure 7:
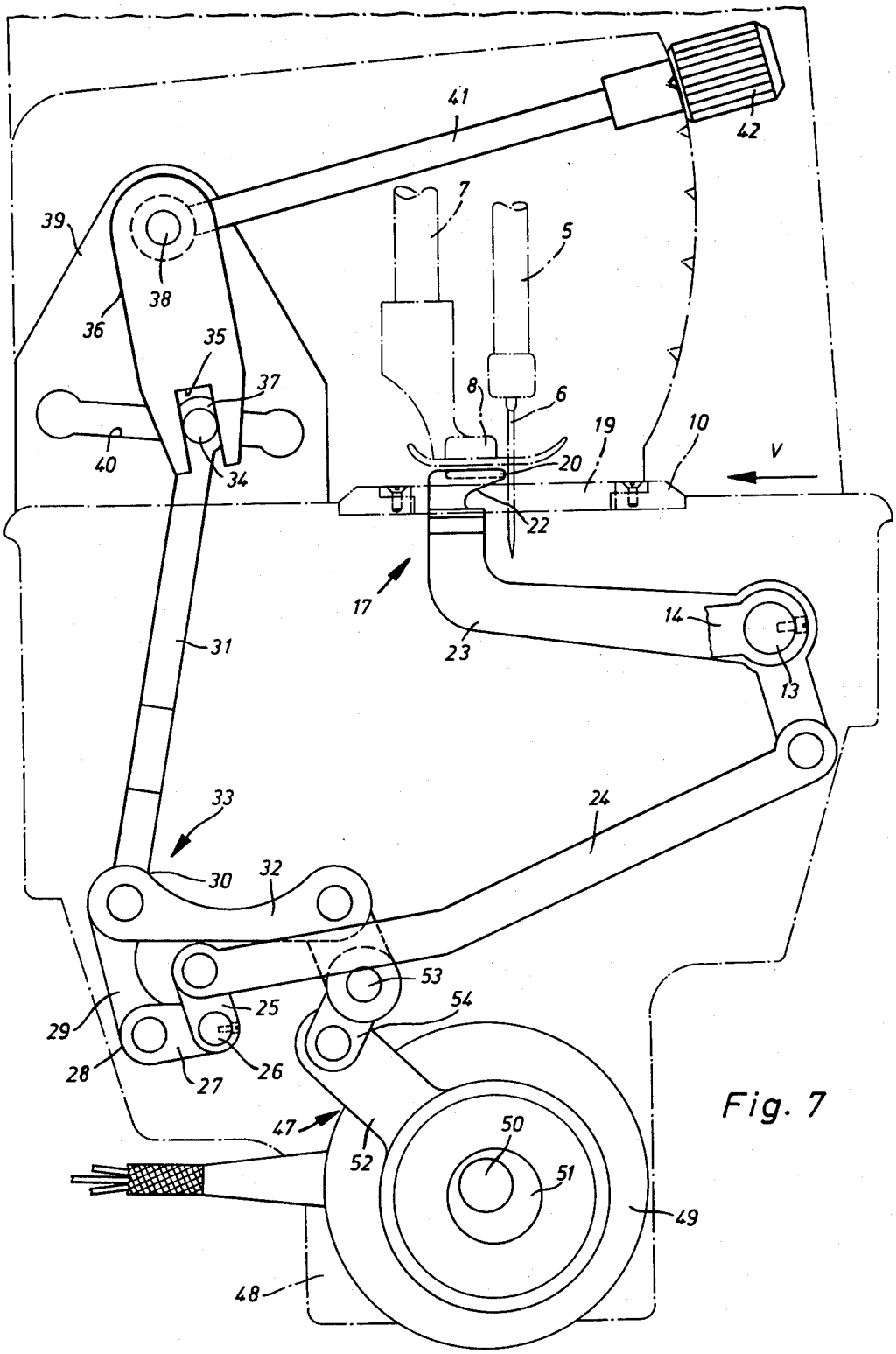
FIG. 7 is a view similar to FIG. 6 showing the knife driving parts in their first position.

By displacement of the upper joint 37 of the toggle lever transmission 33 within the guide slot 40, the stroke height of the top knife 20 can be adapted to different thicknesses of the work, a displacement of joint 37 to the left in FIG. 1, 6 or 7 reducing the stroke height, and a displacement to the right increasing the stroke height. Due to the slant of the guide slot 40, the connecting rods 29, 31 are swung, with displacement of joint 37 to the left, from a more sharply bent position to a less bent, flatter position. In flatter bent position, the link 32, which swings back and forth with unchanged stroke width, moves the connecting rods 29,31 through the extended position into a second bent position. However, the second bent position is always much flatter than the first bent position, so that the top knife 20 cannot come into contact with the work when the connecting rods 29,31 are in the second bent position. The result of this is that the time for traversing the lower half of the movement path of the top knife 20 is shorter still than the time $t_3$ indicated in the diagram, and that accordingly the time for traversing the upper half of the movement path is longer than time $t_4$. Thus at small stroke height of the top knife 20 still more favorable movement conditions result than at medium or great stroke height.

If a sewing operation is to take place without simultaneous trimming of the work, lever 41 is pivoted all the way down. In this way the joint 37 is shifted to the left end of the guide slot 40 in FIG. 1, thereby lowering the top knife 20 completely under the upper face of the stitch plate 10.

Thus, in accordance with the invention, there is provided a sewing machine having a cutting device for the work including a bottom knife disposed in the plane of the work bearing surface and a top knife movable in the vertical direction, whose drive device is formed by a toggle lever transmission comprising two articulatedly connected connecting rods. The central joint of the rods is connected to a drive element and the outer joint of one of the two connecting rods is connected to top knife. The connecting rods 29, 31 can be swung back and forth by means of an eccentric drive 47 between a bent position and a substantially extended position, the top knife 20 being, when the connecting rods 29,31 are in extended position, in a raised position removed from the bottom knife 19 and, when they are in bent position, in a lowered position cooperating with the bottom knife 19. The sewing machine is preferably still further characterized in that the outer joint 37 of the connecting rod 31 not connected with the top knife 20 can be displaced in a direction extending obliquely to the extended position of the connecting rods 29,31.

While a specific embodiment of the invention has been shown and described in detail to illustrate the application of the principles of the invention, it will be understood that the invention may be embodied otherwise without departing from such principles.

What is claimed is:

1. A sewing machine of the type having a work bearing surface in a substantially horizontal plane, a cutting device for the work including a bottom knife disposed in the horizontal plane of the work bearing surface and a top knife movable in a vertical direction, and toggle lever transmission means for driving the cutting device, the transmission means including two connecting rods articulatedly connected at a central joint, a drive member connected to said connecting rods at the central joint, and one of the two connecting rods being connected at an outer joint with the top knife, the improvement comprising an eccentric drive means for swinging the connecting rods back and forth between a bent position and a substantially extended position relative to each other, the top knife being, when the connecting rods are in extended position, in a raised position removed from the bottom knife and, when the connecting rods are in bent position, the top knife being in a lowered position cooperating with the bottom knife.

2. A sewing machine according to claim 1, wherein the other of the two connecting rods which is not connected with the top knife has another outer joint which is displaceable in a direction extending obliquely to the extended position of the connecting rods, and including means for holding said other outer joint a selected position in said direction extending obliquely to the extended position.

* * * * *